US007427068B2

(12) United States Patent
Middleton

(10) Patent No.: US 7,427,068 B2
(45) Date of Patent: Sep. 23, 2008

(54) TRANSCENDENTAL ELEMENT CARD GAME USING DIE

(76) Inventor: Richard G. Middleton, 1271 First St., SE., Columbia, SC (US) 29209

( * ) Notice: Subject to any disclaimer, the term of this patent is extended or adjusted under 35 U.S.C. 154(b) by 0 days.

(21) Appl. No.: 11/566,093

(22) Filed: Dec. 1, 2006

(65) Prior Publication Data

US 2007/0145685 A1 Jun. 28, 2007

Related U.S. Application Data

(63) Continuation of application No. PCT/US2004/017531, filed on Jun. 3, 2004.

(51) Int. Cl.
*A63F 1/00* (2006.01)

(52) U.S. Cl. ..... 273/292; 273/146; 273/308

(58) Field of Classification Search ..... 273/292, 273/299, 302–306, 307, 308, 146; D21/376, D21/378–384

See application file for complete search history.

(56) References Cited

U.S. PATENT DOCUMENTS

| | | | | | |
|---|---|---|---|---|---|
| D130,119 | S | | 10/1941 | Dow | D21/379 |
| 4,227,690 | A | * | 10/1980 | Pitkanen | 273/445 |
| 4,327,919 | A | * | 5/1982 | Vennor | 273/236 |
| 5,441,277 | A | * | 8/1995 | Lenhart et al. | 273/249 |
| 5,746,432 | A | * | 5/1998 | Feola | 273/274 |
| 5,758,878 | A | * | 6/1998 | Brown | 273/274 |
| 5,887,873 | A | * | 3/1999 | Freeman | 273/303 |
| D457,571 | S | * | 5/2002 | Edwards, Jr. | D21/376 |
| 6,598,880 | B2 | * | 7/2003 | Addabbo | 273/306 |
| 6,709,336 | B2 | * | 3/2004 | Siegel et al. | 463/43 |
| 6,843,477 | B2 | * | 1/2005 | Simmons, Jr. | 273/292 |
| 2002/0101037 | A1 | * | 8/2002 | Addabbo | 273/303 |
| 2003/0085520 | A1 | * | 5/2003 | Bedford et al. | 273/255 |
| 2004/0090007 | A1 | * | 5/2004 | Simmons, Jr. | 273/292 |
| 2004/0253571 | A1 | * | 12/2004 | Valayer et al. | 434/219 |
| 2006/0163814 | A1 | * | 7/2006 | Frisoli | 273/292 |

FOREIGN PATENT DOCUMENTS

| | | |
|---|---|---|
| GB | 2286131 | 8/1995 |

OTHER PUBLICATIONS

Scarne, J., Scarne's Encyclopedia of Card Games, "Concentration", Harper & Row Publishers, p. 366 (1983).
Scarne, J., Scarne's Encyclopedia of Card Games, "Concentration", Harper & Row Publishers, p. 366 (1983).

* cited by examiner

*Primary Examiner*—William M Pierce
(74) *Attorney, Agent, or Firm*—Haynes and Boone, LLP

(57) ABSTRACT

A game and method for playing same is based on a deck of cards, each card of which uses an icon to represent one element of a transcendental set of elements. Preferably there are three elements in the transcendental set of elements, each one having a value higher than that of one other element of said set and having a value lower than that of the remaining element. Each card also includes a key or transcendental set rule, or portion thereof, so that the players are reminded of which element beats which other element, and an additional statement that relates to the element and provides a fact, tip or recommendation of interest to the player. Several different card games can be played with the deck, including the well-known rock-paper-scissor type of game played traditionally with hand signals, but here with cards.

10 Claims, 7 Drawing Sheets

TRANSCENDENTAL ELEMENT CARD GAME USING DIE

CROSS-REFERENCE TO PRIOR APPLICATIONS

This application is a continuation of International Application No. PCT/US2004/017531, filed on Jun. 3, 2004, the entire disclosure of which is hereby incorporated herein by express reference thereto.

BACKGROUND OF THE INVENTION

This invention relates generally to a novel card game, and, more particularly, to a means and method for playing a game that uses cards and dice, and that has educational features about the environment and recycling or other educational features.

Card games are popular forms of entertainment. Not only are cards easily transported and stored, but also they provide a fairly economical method of passing the time alone or with friends.

Another popular game is the hand game, "rock, paper, scissors." This game is often played as an alternative to a coin toss for making a decision. However, although the game helps to develop some insight into the strategies of other players, it is not otherwise educational. Furthermore, a player may inadvertently make a different hand gesture than the one she intended based on the speed of the game. Accordingly, one possessing more hand-eye coordination than another may unfairly dominate the game. Furthermore, one having a good instinct as to what another will gesture may quickly change their gesture to beat the other. Finally, one may try and deceive the other player after both hands are drawn by quickly changing the hand gesture before the other player is aware of it. There exists a need, therefore, for the players to become evenly matched.

Consequently, by incorporating a game such as the "rock, paper, scissors" game into a card game, and further enhancing the game with educational features, players can play the game more deliberately and other variations of the basic idea of the game become possible.

SUMMARY OF THE INVENTION

The following presents a simplified summary of the invention in order to provide a basic understanding of some aspects of the invention. This summary is not an extensive overview of the invention. It is not intended to identify key or critical elements of the invention or to delineate the scope of the invention. Its sole purpose is to present some concepts of the invention in a simplified form as a prelude to the more detailed description that is presented later.

The present invention is a card game and a method for playing a card game. The card game includes a deck of cards showing icons that represent elements of a transcendental set of elements. Each card of the deck of cards shows the icon corresponding to one element of the transcendental set and that particular icon will appear on plural cards of the deck of card. Each element is represented on plural cards of the deck.

A transcendental set of elements is a set of elements in which each element has a value only with respect to other elements of the set. Each element will have a higher value than at least one other element and a lower value than at least one other element; there is no element that has the highest value and no element that has the lowest value. In a three-element transcendental set, each element has a higher value than one of the other elements and a lower value than the remaining element. Play involving two players may involve chance drawing of cards, with the winner of each trick being the player who draws the higher value card, if any, or may involve choices by each player from a hand held by that player in order to win tricks. The object of the game is to accumulate the most points (tricks).

The icons represent the elements pictorially on the cards of the deck. In the transcendental set containing the three elements rock, paper, and scissors, the icons on the cards will look like a rock, a sheet of paper, and a pair of scissor, respectively. The relative value of an element represented on a card with respect to the other elements is indicated on a card by showing the element it will beat, as a key, or portion of the transcendental set rule that governs the relationship of the values of the elements of the transcendental set. For example, on the rock card, the rock icon will be shown beating the scissors icon because the scissors element has a lower value than the rock element; by implication the rock element does not beat the sheet of paper element because it can only beat one element of the three-element transcendental set. The scissor icon on the scissor card will be shown to beat the paper icon because the value of the scissors element is higher than the value of the paper element. As will follow, the paper card will show the paper icon beating the rock icon because the paper element has a higher value than the rock element. The transcendental rule would be rock>scissors>paper>rock.

Other transcendental element sets can be used in place of the rock-paper-scissor set.

Each card in the preferred embodiment will have an additional statement related to the environment. In particular, the statement will be an educational statement such as a fact or tip or recommendation that relates specifically to the environment, the effects of pollution, and recycling. For example, the rock card may include a fact related to how much recyclable material is wasted.

In an exemplary embodiment, each card from a set of cards has one icon selected from the three-element transcendental set including rocks, papers, and scissors. The icon of a rock, paper, or scissors will appear at the top of the card to indicate which element is represented by that card. Below this icon is the key, namely, the portion of the transcendental set rule, indicating which of the other two elements the element represented by this card will beat. Finally, below the explanation is included an educational fact regarding the environment. Of the cards in the deck, typically one third will represent each element of the transcendental set. A deck might have 51 cards, 17 of each element.

In an alternative embodiment, the cards can include elements represented by animal icons. For example, the card game can include an icon of a mouse, a snake, and an elephant. The transcendental set rule among these elements would be mouse>elephant>snake>mouse. The additional statement on each card can describe a fact associated with the environment.

In another alternative embodiment of the invention, the deck of cards can be based on prehistoric animal elements such as dinosaurs, wherein each dinosaur element can eliminate one of the other elements and can be eliminated by the remaining element in the card deck.

A feature of the present invention is the use of a deck of cards having a combination of a transcendental set and a learning statement on the cards. Because of the ease of the card game, the present invention is particularly suited towards playing by those of a young age. Not only can children learn about counting, as well as picture recognition, but also the use of learning statements can help children practice reading, while teaching them relevant facts about the environment and recycling. The card game can be played in any setting, and is also easy for both children and their parents to transport, clean up, and store once playing has finished.

Another feature of the present invention is the use of simple playing cards in combination with the hand game "rock, paper, scissors." As discussed, the hand game is not particularly educational. Furthermore, a player may sometimes make a different hand gesture than intended based on the speed of the game. Accordingly, by combining this game with playing cards, the players become more evenly matched.

BRIEF DESCRIPTION OF THE DRAWINGS

Other features and advantages of the present invention will be apparent to those skilled in the art from a careful reading of the Detailed Disclosure of the Preferred Embodiment presented below and accompanied by the drawings.

DETAILED DESCRIPTION OF THE INVENTION

Figure 1A:
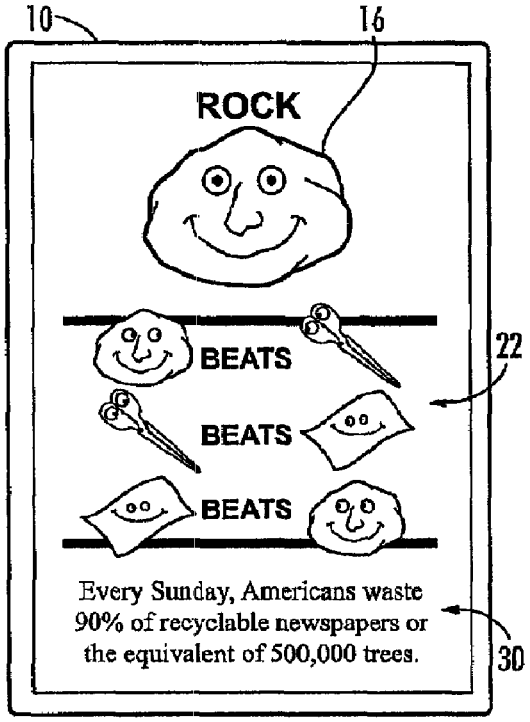
FIG. 1A is a front view of a card from a set of cards according to a preferred embodiment of the present invention.
Figure 1B:
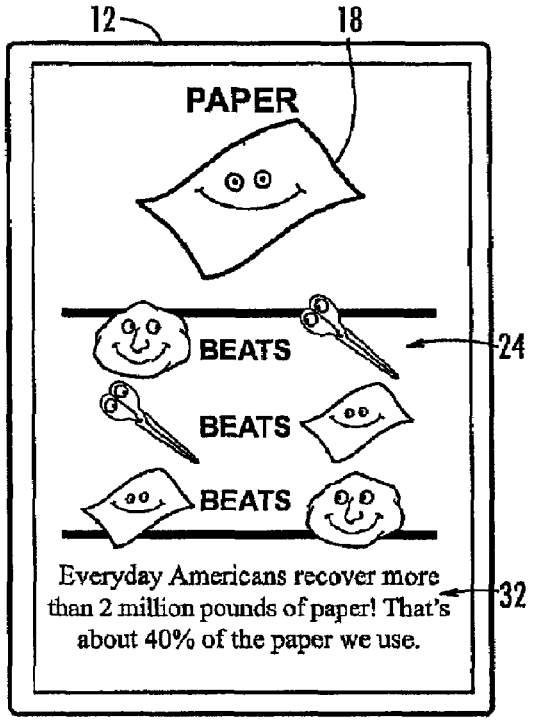
FIG. 1B is a front view of a card from a set of cards according to a preferred embodiment of the present invention.
Figure 1C:
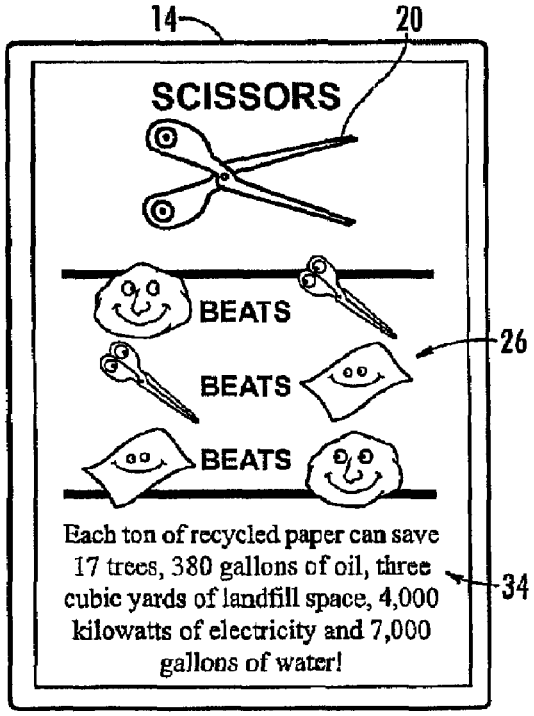
FIG. 1C is a front view of a card from a set of cards according to a preferred embodiment of the present invention.

In an exemplary embodiment illustrated in FIGS. 1A-1C, the set of cards includes a first card 10, a second card 12, and a third card 14. Each card depicts a different icon from a three element transcendental set to represent one of the elements in the set. Preferably, first card 10 depicts a first icon 16 that represents a rock as a first element, second card 12 depicts a second icon 18 that represents a piece of paper as second element, and third card 14 depicts a third icon 20 that represents a pair of scissors as a third element. As discussed, there is no one element from the transcendental set that has a higher value or a lower value than both the remaining elements of the three-element set. Each element has a value that is higher than one other element from the three-element transcendental set and lower than the remaining element of the set.

In addition to first, second, and third icons, 16, 18, 20, each card includes a key or transcendental set rule to show how the relative value of each element compares to one other element. As shown, first card 12 shows a first key 22 in which a rock element is valued higher than the element of a pair of scissors. Second card 14 shows a second key 24 in which a sheet of paper element is valued more than a rock element. Finally, third card shows a third key 26 in which a pair of scissors element is valued more than a piece of paper element.

An educational feature may also be included in the card game in the form of a statement added to the card. As shown, first card 10, second card 12, and third card 14 can also include a first learning statement 30, a second learning statement 32, and a third learning statement 34, respectively. These learning statements relay facts or trivia, tips or recommendations that correlate with the environment, the effects of pollution, and recycling.

Figure 7:
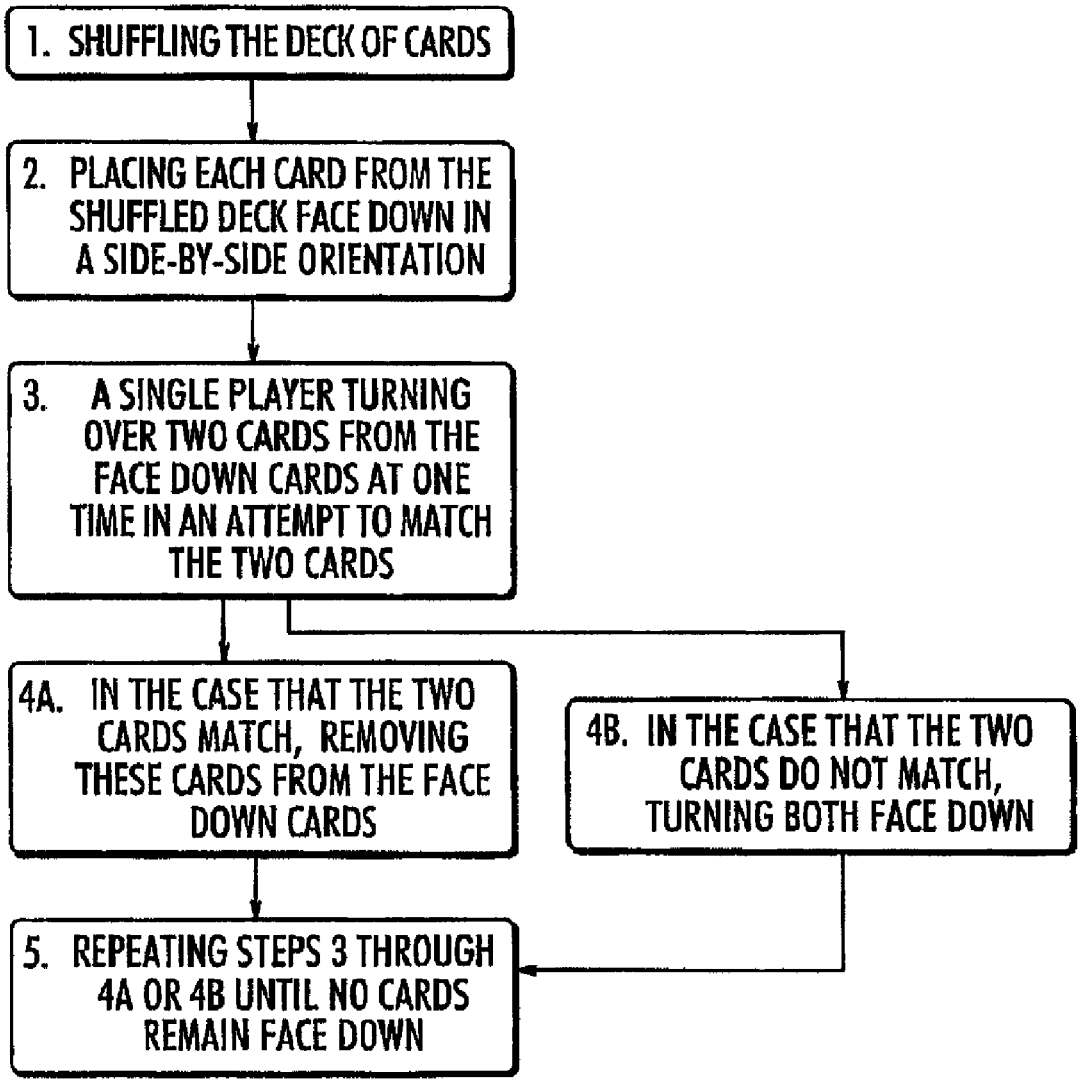
FIG. 7 is a flow chart of a method of playing cards according to a preferred embodiment of the present invention.

A first method of playing a card game with the set of cards illustrated in FIGS. 1A-1C can include the following steps: 1) shuffling the deck of cards; 2) placing each card from the shuffled deck face down in a side-by-side orientation; 3) a single player turning over two cards from the face down cards at one time in an attempt to match the two cards; 4) in the case that the two cards turned over match, removing these cards from the face down cards; 5) repeating steps 3-4 until no cards remain face down. This method is shown in FIG. 7.

Another method of playing a card game with the set of cards illustrated in FIGS. 1A-1C can include the following steps: 1) shuffling the deck of cards; 2) placing the shuffled deck between two players; 3) drawing by each player one card from the deck of cards; 4) each player laying down her drawn card face-up; 5) determining which of the two cards laying face up is of greater value based on the set rule shown on the cards; 6) the player having the card with the higher value then winning the trick and taking the two cards; 7) if the cards drawn by players result in a tie, repeating steps 3 and 4 until a player wins the trick and then takes all cards drawn since the previous trick was won; 8) repeating steps 3-7 until the entire deck of cards has been played; and 9) computing a score in accordance with a scoring rule, such as the player who has accumulated the most cards wins.

Figure 2:
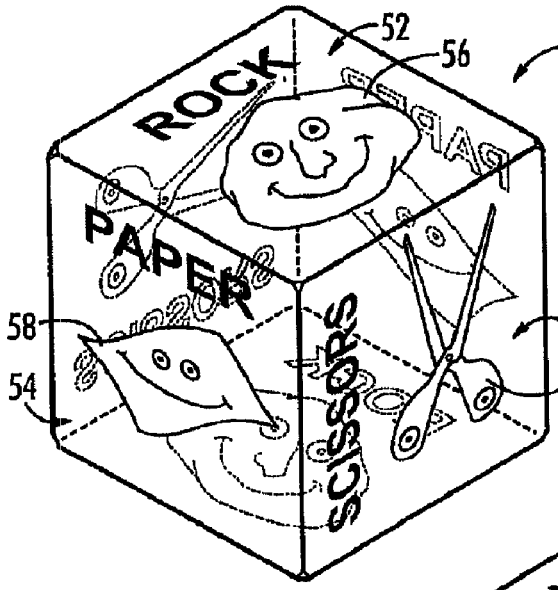
FIG. 2 is a perspective view of a die according to a preferred embodiment of the present invention.
Figure 8:
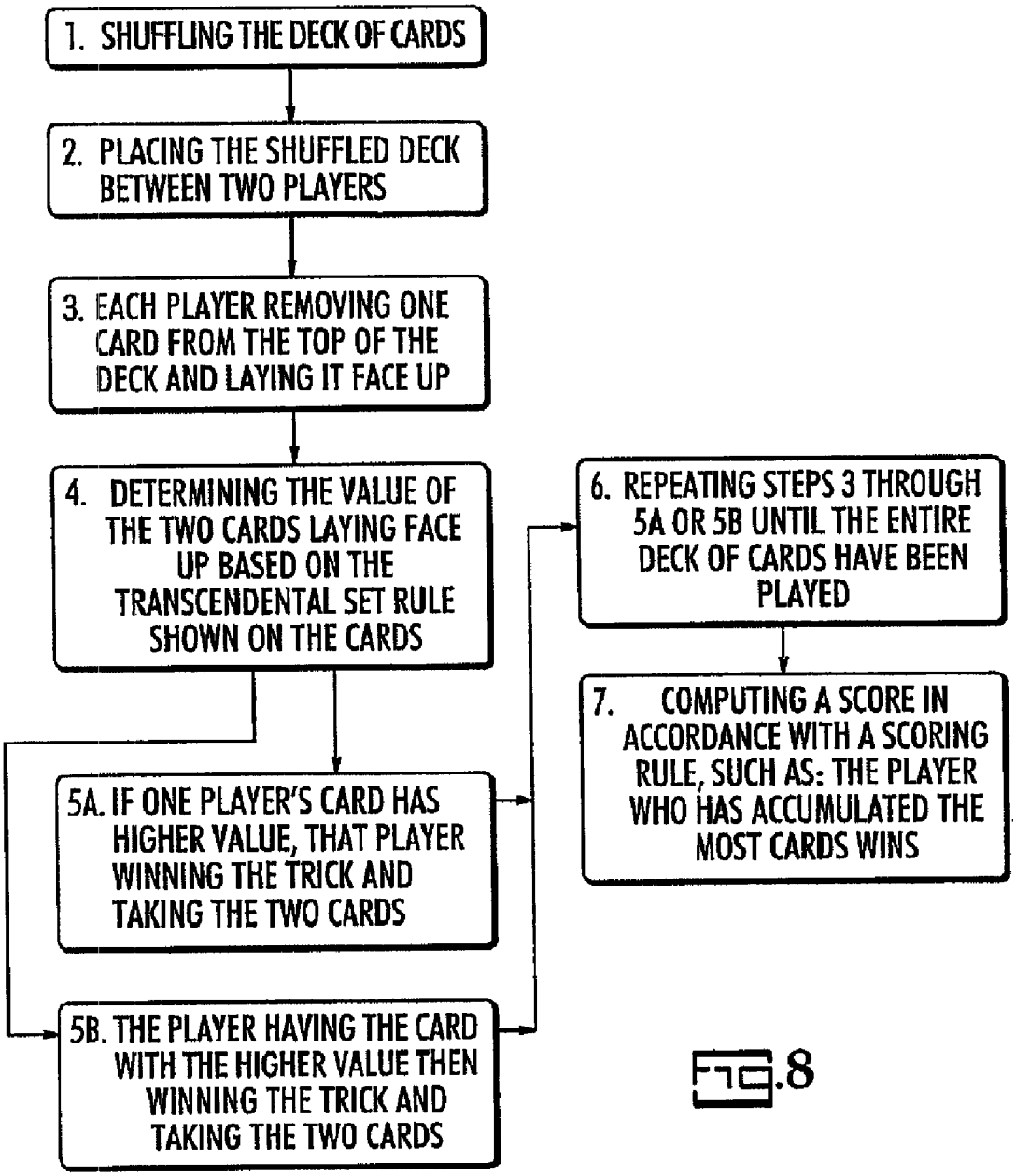
FIG. 8 is a flow chart of a method of playing cards according to an alternative embodiment of the present invention.

In an alternative method of play, shown in FIG. 8, the steps would be substantially similar to the steps of the forgoing method, except that on step 7), rather than repeating steps 3 and 4, the players would instead take turns rolling a die 50 to resolve the tie. The player that wins the trick then takes all cards drawn since the trick was won. As shown in FIG. 2, the die 50 is preferably a six-sided die having an element represented by an icon on each of the six sides. Similar to the cards from the deck, three faces of the six-sided die 50 depict a different icon from a three element transcendental set to represent one of the elements in the set. The opposing faces of these three faces preferably include the same three icons, or matching icons. Depending on the particular rules of the game, the icons of the die 50 can match those of the cards. For example, if the game included cards having first icon 16 representing a rock as a first element, second icon 18 representing a piece of paper as second element, and third icon 20 representing a pair of scissors as a third element, then the die 50 used would include a first face 52 having a first icon 56 representing a rock as a first element, a second face 54 having a second icon 58 representing a piece of paper as a second element, and a third face 55 having a third icon 60 representing a pair of scissors as a third element. As discussed, the remaining three faces of the six-sided die 50 would also include first, second, and third icons 56, 58, and 60, wherein the opposing faces of the die 50 would include matching icons. Alternatively, the icons of the die 50 can be different than those of the cards. However, if the icons of the die 50 do match the icons of the cards, then the same transcendental set rules applicable to the cards are applicable for the die 50.

Regardless of the icons represented on the die 50, during a tie-breaking round, the players each take a turn rolling the die 50. Depending on the particular transcendental set rule governing the 50, the player that rolls the higher valued icon wins the tiebreaker. If the die 50 rolling also results in a tie, the players simply keep rolling until one of the players rolls a higher valued icon.

As an alternative to the foregoing game, two players playing the game can first be dealt a hand of cards, such as seven, and then each player selects one card from her hand to play against the card selected by her opponent from the opponent's hand. Simultaneously, the two players throw down their selected cards face up. The higher valued card takes the trick; in the event of a tie, the "diebreaker" or the six-sided die 50 may be used to resolve the tie.

Figure 9:
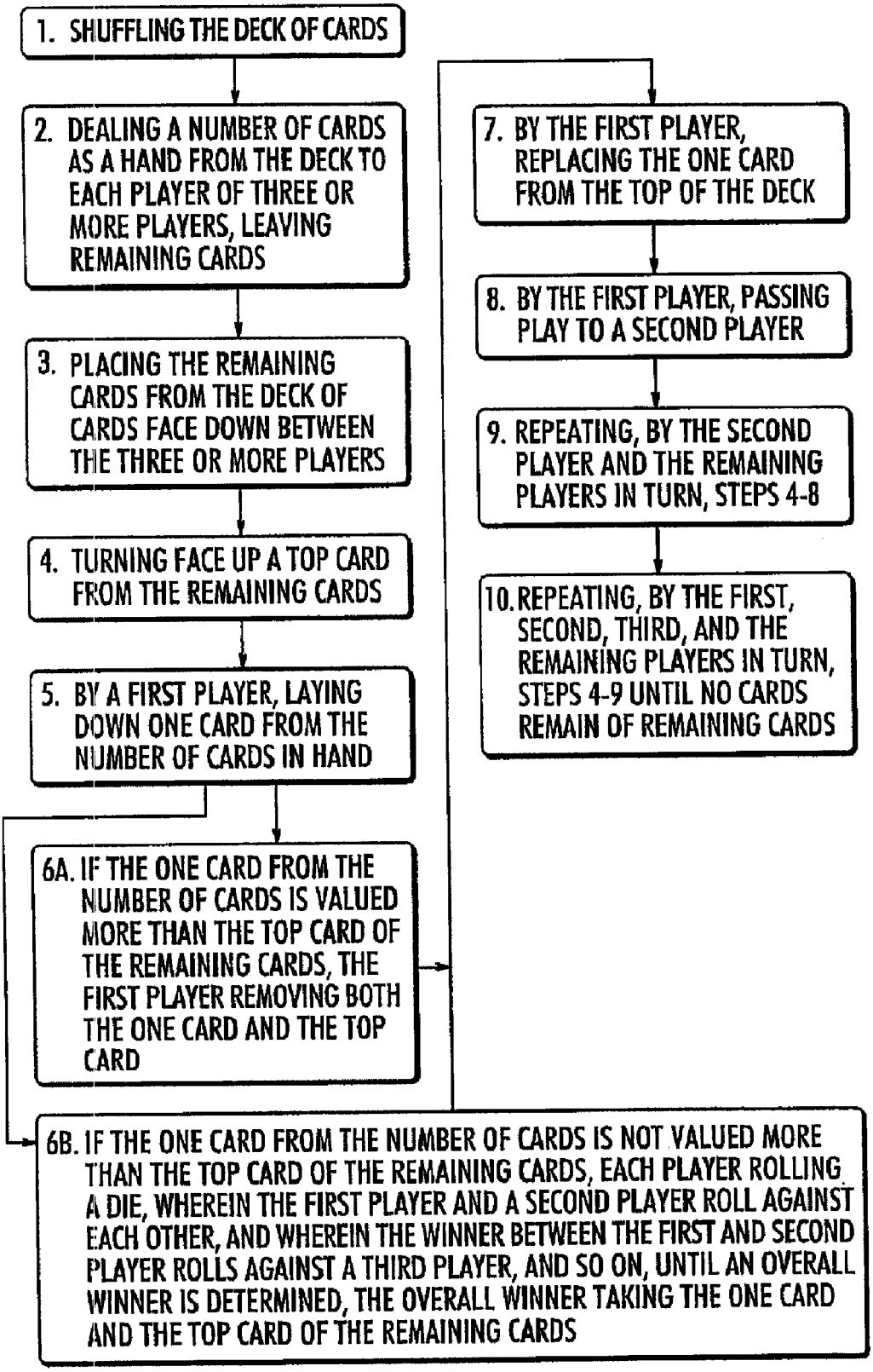
FIG. 9 is a flow chart of a method of playing cards according to an alternative embodiment of the present invention.

In FIG. 9, alternative methods of playing a card game with the deck of cards illustrated in FIGS. 1A-1B by more than two players are shown. For example, the steps can be: 1) shuffling the deck of cards; 2) dealing to each of three or more players a number of cards from the deck of cards; 3) placing the remainder of the deck of cards face down between the three or more players; 4) turning the top card from the deck face up; 5) then, taking turns among the players in either a clockwise or counterclockwise fashion, laying down one card from number of cards in hand; 6) removing both cards facing up if, during that player's turn, the played card has a higher value than the top card on the deck of cards; 7) if the player successfully took that trick, she is dealt a replacement card; 8) repeating steps 4-7 until all the cards from the deck of cards have been played; and 9) computing a score in accordance with a scoring rule, such as the player who has taken the most cards wins. In the case that the player cannot beat the card facing up when it is her turn, then all the players can roll the die 50 to determine the winner of the trick. First, the player taking her turn rolls the die 50, and next the player next to her rolls the die 50. The winner of the trick between those players rolls the die 50 against the remaining third player, if the game only includes three players. If there are more than three players, these steps are repeated until a final winner is determined among the players rolling the die 50. Once the winner among all the players is determined, the player next to the player originally having a turn takes her turn. These tie-breaking steps are repeated as needed until all the cards have been played. If the die 50 used in this game includes elements matching those of the cards, an alternative tie breaking step would be to simply allow the player taking a turn to roll the die 50 against the top card on the deck of cards. If that player cannot beat the top card, then the player simply passes to the next player. If, after all three players have taken a turn, the top card of the deck still cannot be beaten, then rolling commences by the first player until the top card is beaten.

Figure 3A:
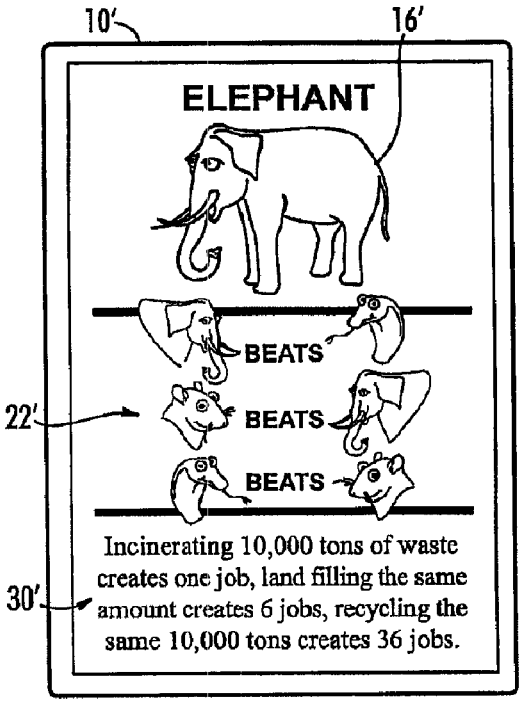
FIG. 3A is a front view of a card from a set of cards according to an alternative embodiment of the present invention.
Figure 3B:
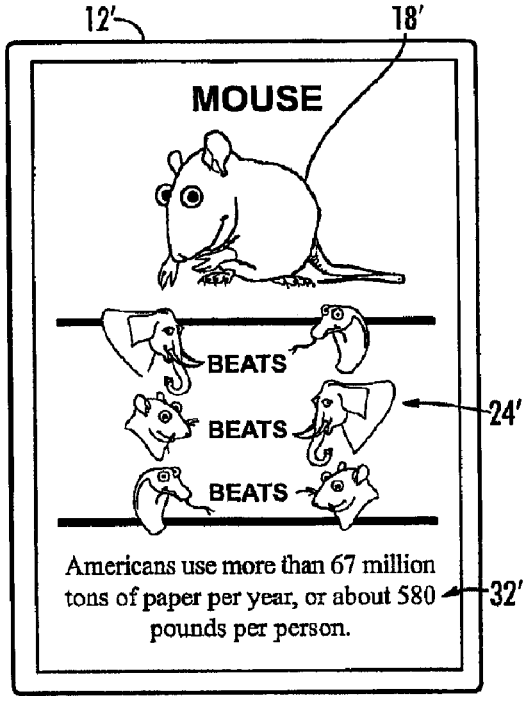
FIG. 3B is a front view of a card from a set of cards according to an alternative embodiment of the present invention.
Figure 3C:
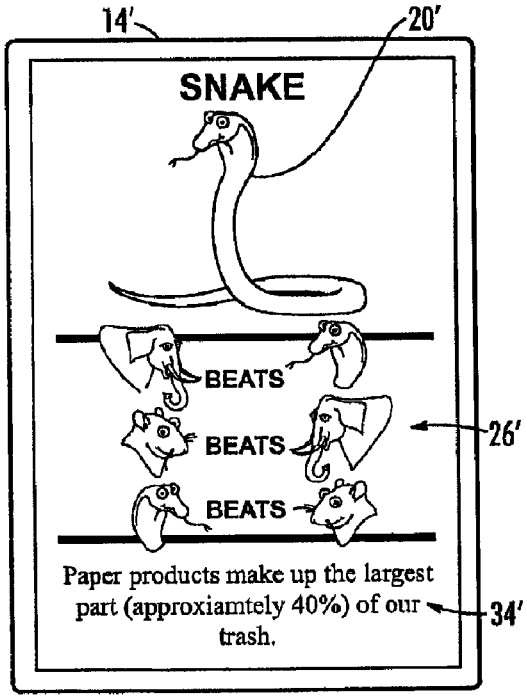
FIG. 3C is a front view of a card from a set of cards according to an alternative embodiment of the present invention.
Figure 5A:
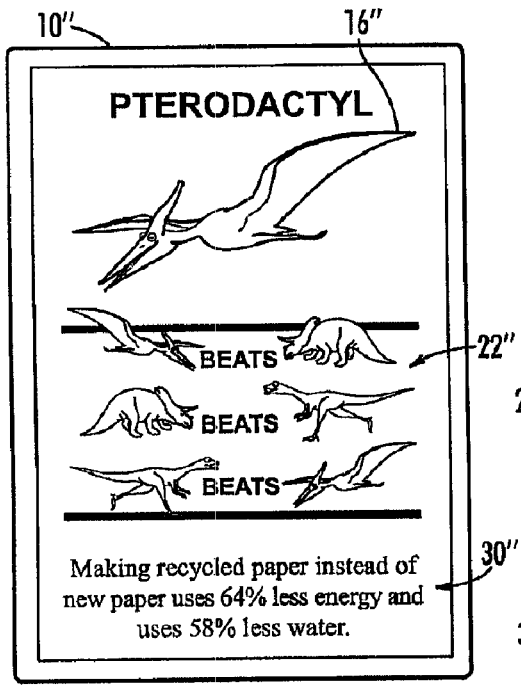
FIG. 5A is a front view of a card from a set of cards according to another alternative embodiment of the present invention.
Figure 5B:
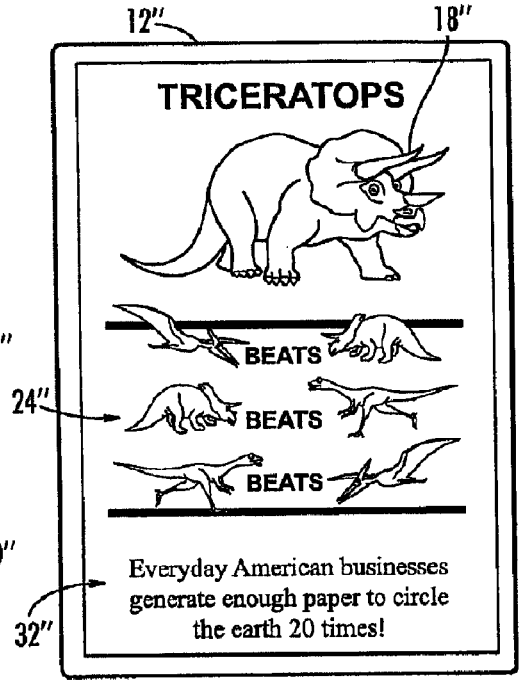
FIG. 5B is a front view of a card from a set of cards according to another alternative embodiment of the present invention.
Figure 5C:
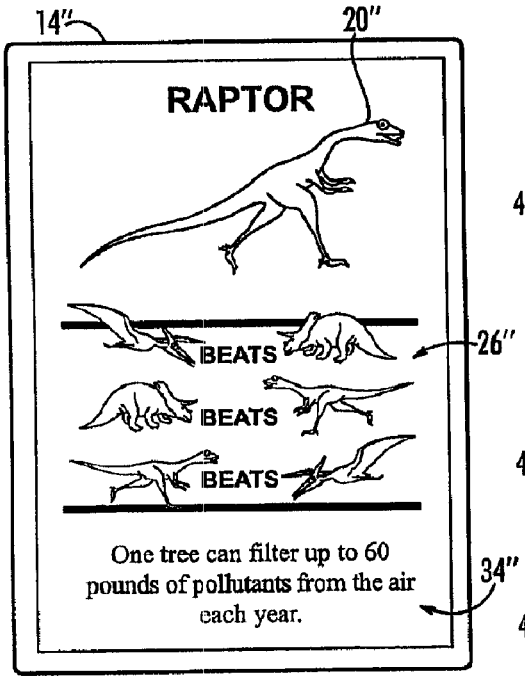
FIG. 5C is a front view of a card from a set of cards according to another alternative embodiment of the present invention.
Figure 5D:
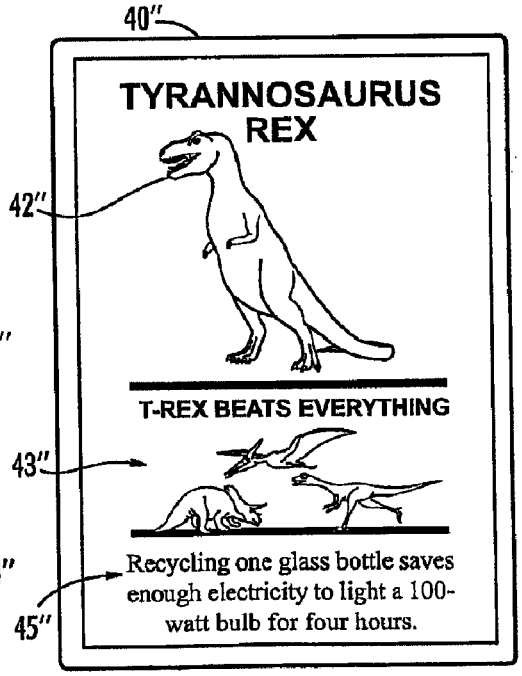
FIG. 5D is a front view of a card from a set of cards according to another alternative embodiment of the present invention.

In a first alternative embodiment, the cards of the set of cards can use animals as elements. As illustrated in FIGS. 3A-3C, first card 10' can include first icon 16' that represents an elephant as a first element. Second card 12' can include second icon 18' that represents a mouse as a second element. Third card 14' can include third icon 20' that represents a snake as a third element. Below first, second, and third icons, 16', 18', and 20' can also be included first learning statement 30', second learning statement 32', and third learning statement 34', respectively. Finally, first, second, and third cards, 10', 12', and 14', can include first, second, and third keys, 22', 24', 26', which designate the values of each element and how the elements interrelate.

Figure 4:
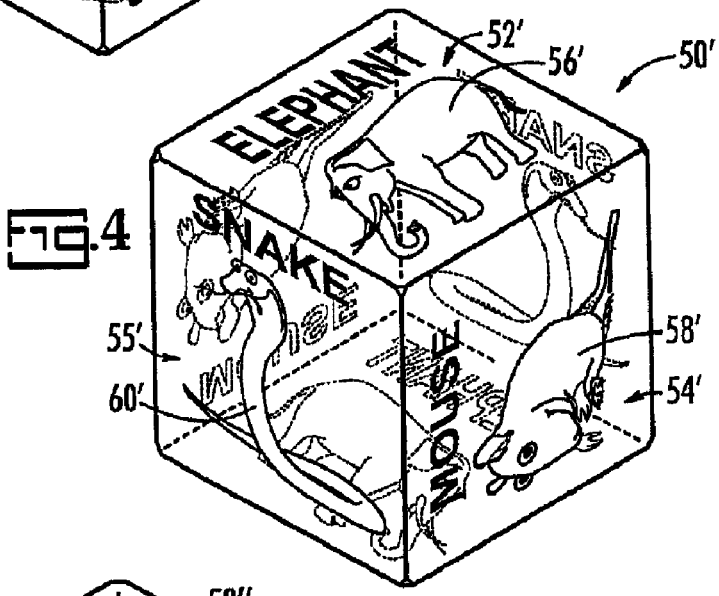
FIG. 4 is a perspective view of a die according to an alternative embodiment of the present invention.

When playing with this alternative deck of cards, the die 50' (shown in FIG. 4) used could include a first face 52' having a first icon 56' representing an elephant as a first element, a second face 54" having a second icon 58' representing a mouse as a second element, and a third face 55' having a third icon 60' representing a snake as a third element. The remaining three faces of the six-sided die 50' would also include first, second, and third icons 56', 58', and 60', wherein the opposing faces of the die 50' would include matching icons.

In a second alternative embodiment, the cards of the set of cards can include elements represented by icons of prehistoric animals. As illustrated in FIGS. 5A-5D, first card 10" can include first icon 16" that represents a pterodactyl as a first element. Second card 12" can include second icon 18" that represents a triceratops as a second element. Third card 14" can include third icon 20" that represents a raptor as a third element. Below first, second, and third icons, 16", 18", and 20" can also be included first, second, and third keys, 22", 24", 26", which designate the values of each element and how the elements interrelate. Learning statements relating to the prehistoric animals can also be included on each card of the set of cards. Alternatively, a fourth card 40 can be included in the set of cards that can act as a wild card. As shown in FIG. 3D, fourth card 40 can include a fourth icon 42 that represents a tyrannosaurus rex as a fourth element. This card can also include a fourth key 43 and a fourth learning statement 45. In the case that the set of cards includes first card 10", second card 12", third card 14", and fourth card 40, methods for playing cards as previously described are not altered except that fourth card 40 is given the highest value among all the cards in the set. Although the number of cards included within a set is not relevant to the present invention, the set of cards can include seventeen first cards 10", seventeen second cards 12", seventeen third cards 14", and six fourth cards 40.

Figure 6:
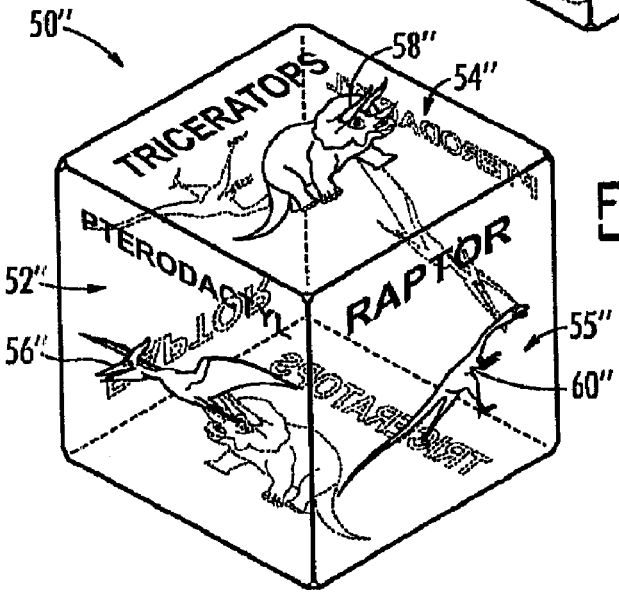
FIG. 6 is a perspective view of a die according to an alternative embodiment of the present invention.

When playing with this alternative deck of cards, the die 50" (illustrated in FIG. 6) used could include a first face 52" having a first icon 56" representing a pterodactyl as a first element, a second face 54" having a second icon 58" representing a triceratops as a second element, and a third face 55" having a third icon 60" representing a raptor as a third element. The remaining three faces of the six-sided die 50" would also include first, second, and third icons 56", 58", and 60", wherein the opposing faces of the die 50" would include matching icons.

It is contemplated that the dice 50, 50', and 50" of the present invention can be interchanged with the alternative decks of cards. In other words, the elements of the dice used in the tie breaking steps of the methods for playing cards need not necessarily match the elements of the deck of cards. In this instance, a separate set of transcendental set rules apply for the particular die used than apply to the cards used. This separate set of transcendental set rules can be presented in the form of instructions for the game.

It is also contemplated that the dice of the present invention, 50, 50', and 50", respectively, can be played without the use of the deck of cards. For example, two players could take turns rolling one of the dice and play in a similar fashion to the hand game "rock, paper, scissors." Furthermore, although a six-sided die 50 is shown and described, this is only an exemplary embodiment of the die that could be used in the present invention. For example, dice of varying numbers of faces, ranging from 3-sided and above, could also be employed.

Furthermore, it is contemplated by the present invention that the playing cards could be incorporated into a computer game or video game. Such a game could only enhance the learning of small children who will certainly require computer skills considering the current direction in which technology is moving.

Those skilled in the art of card games will recognize that many substitutions and modifications can be made in the foregoing preferred embodiment without departing from the spirit and scope of the present invention.

What is claimed is:

1. A method for playing a game, comprising:

(a) shuffling a deck of cards, wherein each card from said deck of cards represents one element from a three element transcendental set of elements, wherein each element is depicted on said card by an icon, and wherein said each element is represented by plural cards in said deck;

(b) dealing a number of cards as a hand from said deck to each player of at least three players, leaving remaining cards;

(c) placing said remaining cards from said deck of cards face down between said at least three players;

(d) turning face up a top card from said remaining cards;

(e) by a first player of said at least three players, laying down one card selected from said hand of said first player;

(f) by said first player, removing both said one card and said top card only if said one card is valued more than said top card of said remaining cards and rolling a die only if said one card is not valued more than said top card, wherein said die includes a plurality of faces, and wherein each face of said plurality of faces represents said one element from said three element transcendental set of elements;

(g) by said first player, passing play to another player only if after said rolling step, the top face of said die is not valued more than said top card;

(h) by said first player, taking a card from said remaining cards for said hand to replace said one card;

(i) by said first player, turning face up a next top card from said remaining cards; and (j) repeating, by the remaining players of said at least three players in turn, steps (e) through (i) until no cards remain of said remaining cards.

2. A method for playing the game of claim 1, further comprising, between the first player passing play and taking a card: a second player, taking turns with said first player rolling said die until one of said first player and said second player wins a first trick by having said die land with a winning element from said three element transcendental set of elements facing up; and a third player, taking turns with a winner of said first trick rolling said die until one of said winner of said first trick and said third player wins a second trick by having said die land with said winning element from said three clement transcendental set of elements facing up, wherein a winner of said second trick removes both said one card and said top card.

3. The method of claim 1, further comprising:

placing said top card back into said remaining cards when each of the players passes in a complete round of turns; and turning over a next top card from said remaining cards.

4. The method of claim 1, which further comprises computing a score for each of the players.

5. The method of claim 1, wherein each of the elements of the transcendental set of elements is selected as an animal.

6. The method of claim 5, wherein each of the elements of the transcendental set of elements is selected as a prehistoric animal.

7. The method of claim 1, wherein the transcendental set of elements is selected to include rock, paper, and scissors.

8. The method of claim 1, wherein each of the cards carries a transcendental set rule that governs the relationship of the values of the elements of said transcendental set.

9. The method of claim 8, wherein each card carries a portion of the transcendental set rule defining the element it will beat.

10. The method of claim 1, wherein each card from the deck is selected to include a learning statement related to recycling.

* * * * *